US005120022A

United States Patent [19]

Kubik

[11] Patent Number: 5,120,022

[45] Date of Patent: Jun. 9, 1992

[54] HYDRAULIC DRIVE SYSTEM FOR LIFT PLATFORM

[76] Inventor: Philip A. Kubik, 1527 Lockridge, Bloomfield Hills, Mich. 48013

[21] Appl. No.: 538,579

[22] Filed: Jun. 15, 1990

[51] Int. Cl.[5] ..... B66F 3/00

[52] U.S. Cl. ..... 254/124

[58] Field of Search ..... 254/122, 124, 9 R, 9 B, 254/9 C, 10 R, 10 B, 10 C, 8 R, 8 B, 8 C

[56] References Cited

U.S. PATENT DOCUMENTS

| | | | |
|---|---|---|---|
| 1,325,863 | 12/1919 | Rose | 254/9 C |
| 2,471,901 | 5/1949 | Ross | 254/9 C |
| 3,319,932 | 5/1964 | Szczepanik | 254/9 C |

*Primary Examiner*—Robert C. Watson
*Attorney, Agent, or Firm*—Basile and Hanlon

[57] ABSTRACT

A hydraulically powered lift system for raising and lowering lift platforms of relatively large area employs two sets of hydraulic cylinders hydraulically connected in parallel in a closed loop system to a main system pump via a directional control valve. The piston rods of both sets of cylinders are mechanically connected to the lift platform, but the mechanical interconnections between the rods of one set of cylinders and the lift platform differ from those employed between the rods of the other set of cylinders and the lift platform. The differing types of mechanical interconnections establish a mechanical advantage of one set of cylinders which is substantially constant throughout a working stroke while the mechanical advantage of the other set of cylinders is variable over the stroke, the parallel hydraulic connections of the cylinders distributing the fluid supplied by the pump to maintain a common equal pressure at all cylinders. Various linkage arrangements for uniformly distributing the applied forces over the entire area of the platform and throughout the linkage system to equalize pivot wear are disclosed.

10 Claims, 3 Drawing Sheets

HYDRAULIC DRIVE SYSTEM FOR LIFT PLATFORM

BACKGROUND OF THE INVENTION

The present invention is directed to a hydraulically powered lift system for raising and lowering lift platforms of relatively large area.

In my U.S. Pat. No. 4,751,818, there is disclosed a hydraulic drive system operable to raise and lower a platen. The system there disclosed employs two or more lift cylinders having their piston rods coupled directly to the lift platen and a rotary hydraulic motor whose shaft drives a crank coupled by a link to the platen in a manner such that rotation of the crank from a six o'clock position relative to its axis to a twelve o'clock position will drive the platen from its lower end limit of movement to its upper end limit of movement. The lift cylinders and the rotary hydraulic motor are hydraulically connected in parallel with each other to a main system pump in a closed loop system via a three position directional control valve.

The geometry of the crank-link connection between the rotary motor shaft and the platen is such that the vertical component of movement transmitted by the link to the platen is relatively small when the crank is near its six o'clock or twelve o'clock position relative to the crank axis and is a maximum at the midpoint of rotation of the crank when the crank is at a nine o'clock orientation to the shaft axis. The effective vertical force applied via the crank varies inversely with its vertical component of movement. The lift cylinders, on the other hand, would normally drive at a constant speed and exert a constant lift force on the platen throughout their stroke. Because the piston rods of the lift cylinders and the output shaft of the rotary motor are both mechanically coupled to the lift platen, and the lift cylinders and rotary motor are hydraulically connected in parallel with each other to the main system pump, the output of the main system pump will be distributed between the rotary motor and lift cylinders so that the pressure applied to each remains constant—in other words, the system supplies proportionately more fluid to the cylinder or motor whichever is moving the fastest.

In a system of the type disclosed in my U.S. Pat. No. 4,751,818, where the platen is employed to advance or elevate a workpiece from a support into operative relationship with the tool, the relatively small size of the platen employed enables the lift system to employ a minimum number of cylinders and a single rotary motor. Further problems arise in the case where a lift platform of relatively large area is involved. Such platforms may be employed, for example, to lift single parts of relatively large length and width, as for example, a sheet metal automotive body panel or a workpiece lift and transfer system where the platform may be relatively narrow in width, but of substantial length due to the multiple number of work stations involved. In that these applications typically require a precise location of the lift platform relative to tooling which will operate upon workpieces supported by the platform, the elevating forces applied to the platform by the lift system must be uniformly and evenly distributed over the entire area of the platform insofar as is possible. Where the system employs an extensive linkage system, and a single motor is employed to drive a plurality of links connected to the platform at different points on the platform, those pivots in the linkage which are closer to the motor will tend to wear much faster than pivots which are more remote from the motor. This can result in an uneven distribution of force applied to the platform and, in the case of a relatively long platform result in a lengthwise tilting or sagging of the platform where uneven wear in the linkage occurs.

The present invention is directed to a hydraulically operated lift system especially adapted for lift platforms of relatively large area and which uniformly distributes the mechanical and hydraulic operating forces.

SUMMARY OF THE INVENTION

In accordance with the present invention, a hydraulically operated lift system includes two separate sets of hydraulic cylinders, one set of which is preferably a plurality of like three chamber cylinders mounted vertically upon a fixed frame and having their piston rods directly coupled to the lift platform at locations spaced symmetrically about the platform to apply a uniformly distributed vertical force to the platform. These three chamber cylinders have three hydraulically isolated internal chambers to which three separate working faces of the piston are respectively exposed. Two of the three faces of the piston are located on opposite sides of the piston and are of equal area. By connecting one of these two equal area faces to the output of the main system pump and connecting the other equal area face to the intake of the pump, the piston may be driven in movement in a closed loop system. The third face of the piston is at the lower side of the piston and its chamber is connected to a counterbalancing pressure supplying circuit which maintains a pressure on this last face of the piston which counterbalances a percentage weight of the lift platform.

The second set of hydraulic cylinders are mounted upon the fixed frame for a pivotal movement and have their piston rods connected to drive a crank in rotary oscillation about a fixed axis. The crank may be coupled by a link to the lift platform or, alternatively, one or more additional cranks may be mounted upon a shaft driven in rotation by the cylinder driven crank and coupled to the lift platform by a link. A plurality of cranks may be coupled to each other by a common drag link in an arrangement in which the first set of hydraulic cylinders may be coupled to drive certain of the cranks, while one or more second cylinders may be coupled to drive the drag link in crank rotating movement.

Other objects and features of the invention will become apparent by reference to the following specification and to the drawings.

Figure 1:
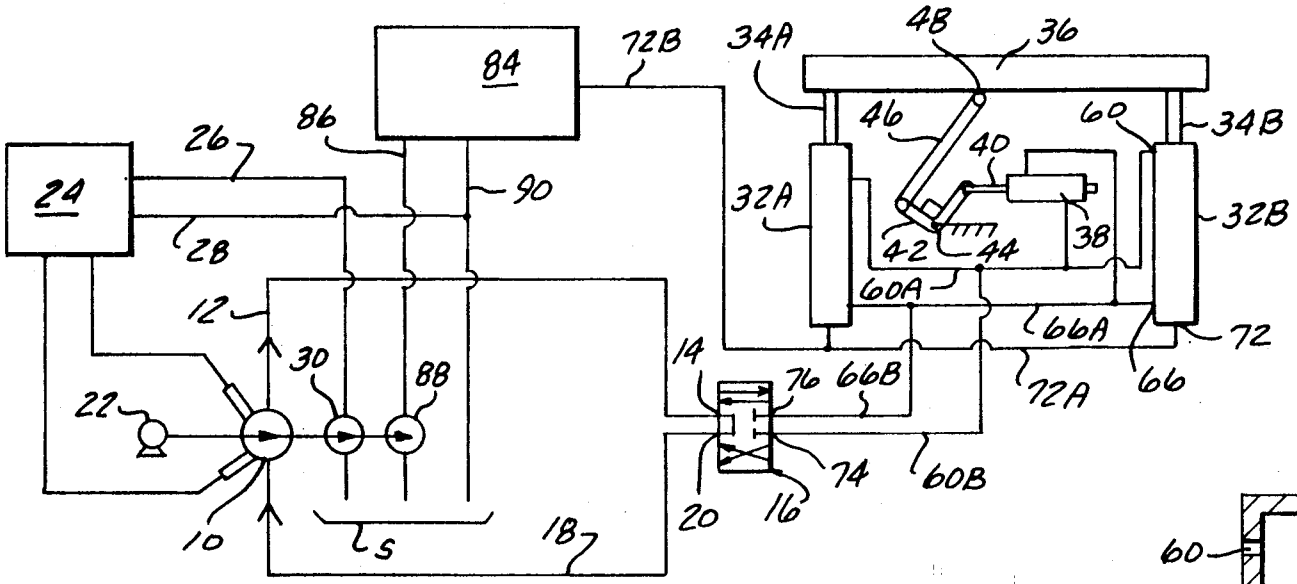
FIG. 1 is a schematic diagram showing a simplified hydraulic system employed in the present invention.
Figure 3:
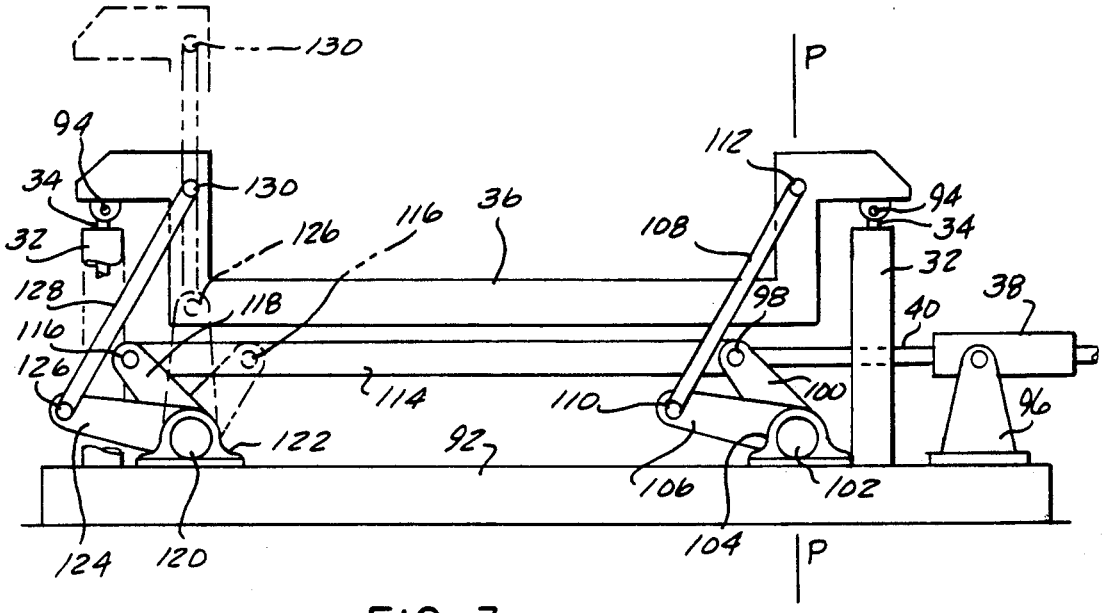
FIG. 3 is a simplified side elevational view, with certain parts broken away, of a lift system embodying the present invention.
Figure 4:
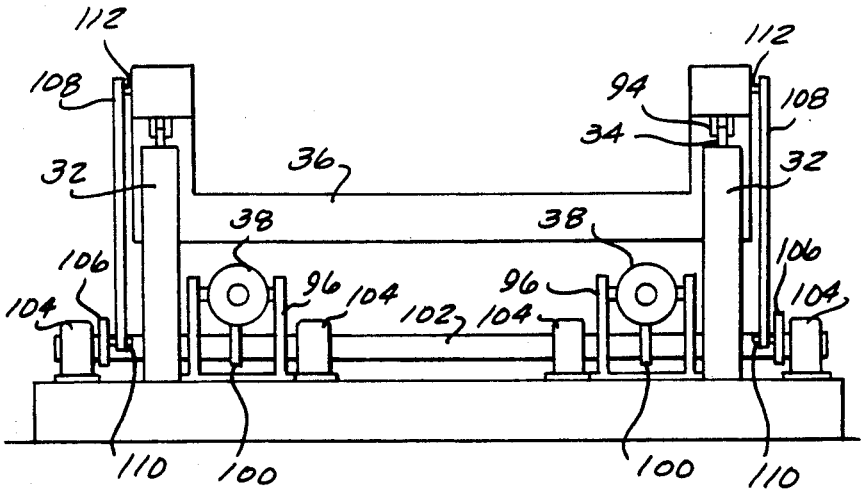
FIG. 4 is an end view of the system of FIG. 3.

Referring first to FIG. 1, a simplified hydraulic circuit as shown connected to a schematically illustrated lift system which may be considered to be a schematic representation of the system shown in somewhat greater structural detail in FIGS. 3 and 4.

The hydraulic circuit of FIG. 1, for purposes of the present disclosure, is the same circuit as disclosed and described in detail in my U.S. Pat. No. 4,751,818, whose disclosure is hereby incorporated by reference.

For purposes of the present application, the hydraulic circuit includes a main system pump 10 whose outlet is connected via a pressure conduit 12 to the pressure port 14 of a three position directional control valve 16. A return line 18 connects the tank port 20 of valve 16 to the intake side of pump 10. When valve 16 is in the normal centered or neutral position shown in FIG. 1, the internal connections within valve 16 connect pressure port 14 to tank port 20 so that when pump 10 is driven by its drive motor 22, pump 10 circulates fluid in a closed loop from its outlet through pressure line 12, pressure port 14 and the centered valve 16 to tank port 20 and thence back to the intake of pump 10 via return line 18.

Pump 10 is preferably a variable displacement pump, such as an axial piston pump whose output is varied by a tilting swash plate in a well known manner. The circuit of FIG. 1 is shown as including a schematically illustrated speed control circuit 24 of well known construction which is supplied with oil via a pressure line 26 connected to the output of a speed control-charge pump 30 whose intake is connected to a sump S. A return line 28 from speed control circuit 24 is also connected to sump S. For a further description of the speed control system, which may be employed to vary the output of pump 10 at selected portions of an operating cycle, see U.S. Pat. No. 4,751,818. Pump 30 may also be employed, in a manner described in U.S. Pat. No. 4,751,818 to charge or replenish fluid in the main system circuit of main system pump 10.

The circuit of FIG. 1 is employed to operate a first pair of hydraulic cylinders 32A, 32B whose piston rods 34A, 34B respectively are connected to a rigid horizontally disposed lift platform 36. A third hydraulic cylinder 38 has its piston rod 40 pivotally connected to one end of a bell crank 42 mounted for rotation about a fixed horizontal axis 44. The opposite end of the bell crank 42 is pivotally coupled to one end of a link 46 whose upper end is pivotally coupled to lift platform 36 by a pivot 48 vertically aligned with fixed pivot 44.

Figure 2:
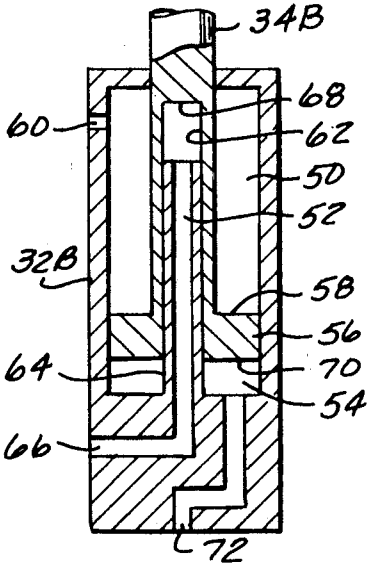
FIG. 2 is a simplified cross sectional view of a three chamber cylinder employed in the system of the present invention.

Cylinders 32A and 32B are of a known three chamber construction schematically shown in the cross sectional view of FIG. 2. The interior of cylinder 32 is divided into three hydraulically isolated chambers 50, 52 and 54. Chamber 50 is a rod end chamber and piston 56 is formed with a rod end face 58 exposed to chamber 50 which opens through the wall of cylinder 32 via a port 60. Rod 34 is formed with a blind bore 62 extending from the head end side of piston 56 coaxially into the rod and an elongate hollow tubular projection 64 projects upwardly from the base of cylinder of 32B to be slidably received within bore 62. Chamber 52 in the interior of tube 64 communicates to the exterior of cylinder 32 via a port 66. The area of the end face 68 of blind bore 62 in the piston rod is equal to the area of the rod end face 58 of piston 56. Because these two areas are equal, chambers 50 and 52 may be connected via ports 60 and 66 to the pressure and return sides of a pump in a closed loop system.

The third chamber 54 in cylinder 32 is exposed to the head end face 70 of piston 56 and is connected to the exterior of cylinder 32 by a port 72.

Referring to FIG. 1, cylinders 32A and 32B are connected in parallel with each other with the port 60 of cylinder 32B being connected via a line 60A to the corresponding port of cylinder 32A, while the ports 66 and 72 of cylinder 32B are likewise connected to the corresponding ports of cylinder 32A by conduits 66A and 72A respectively.

Conduits 60A and 66A are in turn respectively connected via conduits 60B, 66B to control ports 74, 76 respectively of directional control valve 16.

Figure 2A:
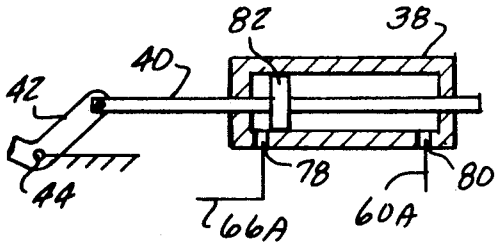
FIG. 2A is a cross sectional view of a double rodded hydraulic cylinder which may be employed in the present invention in place of the cylinder of FIG. 2.

Cylinder 38 may either take the form of a three chamber cylinder of the same construction as cylinder 32 with port 72 vented or, alternatively, may take the form of a conventional double rodded cylinder as illustrated in FIG. 2A. Port 78 at the active rod end of cylinder 38 is connected to conduit 66A, while the port 80 at the idle rod end of cylinder 38 is connected to conduit 60A. The double rodded cylinder is necessary in that cylinder 38 is connected to the main pump system in parallel with cylinders 32A, 32B in a closed loop system, thus it is essential that the opposite end faces of piston 82 be of equal area.

As set forth above, a three chamber cylinder of the same construction as cylinder 32B could be utilized in place of the double rod cylinder 38, in which event, the port 72 would be vented. Counterbalance circuit 84 may take the form of that shown in U.S. Pat. No. 4,751,818, to which reference may be had for further details of the operation of the counterbalance circuit. The counterbalance circuit functions to supply to or release from conduit 72B fluid under pressure sufficient to act on piston face 70 and substantially counterbalance the weight of lift table 36 and any workpieces which may be supported upon the table.

It is believed apparent that by positioning directional control valve 16 to cause the rods of the various cylinders 32A, 32B and 38 to stroke in synchronism will accomplish raising or lowering of lift platform 36 in accordance with the direction of flow through conduits 66B, 60B.

Further details of the mechanical portion of the lift system of FIG. 1 are shown in FIGS. 3 and 4. Although the lift platform 36 is shown in only side and end views in FIGS. 3 and 4, it will be assumed for purposes of the present explanation that platform 36 is of rectangular configuration as viewed in plan and at least four lift cylinders 32 will be mounted at fixed locations upon a fixed base 92 in vertical positions, one cylinder 32 being located adjacent each corner of platform 36. Where the length or width of platform 36 is relatively large, additional lift cylinders 32 may be located at uniformly spaced positions along the length or width of the platform. The piston rod 34 of the cylinders 32 are coupled to platform 36 as by pivotal connections 94, primarily for convenience in assembly in that no pivotal movement between the rods 34 and platform 36 is required. Preferably, the platform 36 will be guided in some positive manner in vertical movement relative to fixed base 92 by suitable conventional means which have been omitted from FIGS. 3 and 4 for purposes of clarity.

Cylinders 32 are of the three chamber construction illustrated in FIG. 2. For purposes of description, it will be assumed that the cylinders 38 of the embodiment of FIGS. 3 and 4 are of the double rodded construction shown in FIG. 2A. Cylinders 38 are mounted upon base 92 for pivotal movement about a horizontal axis as by mounting brackets 96. As best seen in FIG. 4, two cylinders 38 are employed, and the piston rod 40 of each cylinder 38 is pivotally coupled to a crank 100 rotatively locked to a shaft 102 supported for rotation about a horizontal axis upon base 92 as by pillow blocks 104, two of which, as best seen in FIG. 4, are located adjacent opposite ends of shaft 102.

A pair of second cranks 106 are fixedly mounted on shaft 102, adjacent each of the outermost pillow blocks 104. A link 108 is pivotally coupled at one end to each of cranks 106 as by a pivot pin 110 and is pivotally coupled at its opposite end to platform 36 as by a pivot pin 112 whose axis lies in a vertical plane PP containing the axis of shaft 102.

Each pivot 98 also couples each crank 100 to a horizontally extending link 114 whose opposite end is pivotally coupled, as by pivot 116, to a crank 118 rotatively locked to a horizontal shaft 120 mounted on base 92 in parallel relationship to shaft 102 as by pillow blocks 122. Each crank 100, together with its associated horizontal link 114 and crank 118, forms, with a fixed horizontal link constituted by base 92, a parallelogram linkage.

Like shaft 102, shaft 120 also carries at least a pair of second links 124 rotatively fixed to shaft 120. The angular displacement of each crank 124 about the axis of shaft 120 from crank 118 is the same as the angular displacement between cranks 100 and 106 of shaft 102. Each crank 124 is coupled, by pivot pin 126 to a link 128 whose opposite end is pivotally connected to platform 36 as by pivot pin 130. The axis of pivot pin 130 is vertically aligned with the axis of shaft 120. The various links 108 and 128 are connected to the platform at locations adjacent each corner of the platform.

In FIG. 3, platform 36 is shown at its lowermost position. Piston rod 40 is fully extended from its cylinder 38, while piston rods 34 of cylinders 32 are fully retracted. The circuit of FIG. 1 is connected, as shown in FIG. 1, to cause piston rod 40 to be retracted to the right as viewed in FIG. 3 at the same time that piston rods 34 are being elevated or extended from their cylinders 32. Upon movement on piston rod 40 to the right as viewed in FIG. 3, it is believed apparent that cranks 100 and 118 will be drawn with piston rod 40 to the right to cause rotation of the respective shafts 102, 120 in a clockwise direction as viewed in FIG. 3. This clockwise rotation of shafts 102 and 120 carries with it the cranks 106, 124, thereby elevating links 108, 128 to elevate the platform. The vertical guiding means (not shown) associated with platform 36 constrains motion of pivots 112, 130 to straight line vertical movement. The stroke of piston rod 40 is such that a full stroke of the rod swings crank 118 through an angle of approximately 90° about the axis of shaft 120. When piston rod 40 completes its stroke to the right as viewed in FIG. 3, the cranks 106, 124 on shafts 102 and 120 have been shifted to a position such that the pivots 110, 126 of cranks 106, 124 are at or slightly beyond vertical alignment with the axes of their respective shafts 102, 120—see broken line representation of the cranks 118, 124 in FIG. 3. The over center positioning of pivots 110, 126 mechanically locks the platform in its elevated position. Actuation of cylinder 38 to drive its rod to the right from the position shown in FIG. 3, drives pivot 110 upwardly along a circular path centered on the axis of shaft 102. Initial movement of pivot 110 from the position shown in FIG. 3 consists of a relatively large component of vertical movement and a relatively small component of horizontal movement. As crank 106 rotates upwardly toward the vertical, the vertical component of the motion of pivot 110 continuously decreases, while its horizontal component motions continuously increases until, as pivot 110 reaches vertical alignment with the axis of shaft 102, the vertical component becomes zero. Thus, the vertical motion applied to platform 36 is relatively rapid during the initial portion of the elevating stroke and decreases continuously to zero as crank 106 rises to vertical alignment with the axis of the crank shaft 102. Conversely, the mechanical advantage of the crank arrangement is smaller at the beginning of the elevating stroke and increases continuously as crank 106 rotates toward the vertical, and becomes maximum when 106 reaches a 12 o'clock position.

Cylinders 38 and cylinders 32 of the FIGS. 3 and 4 arrangement are connected in the hydraulic circuit of FIG. 1 in parallel with each other and fluid under pressure supplied by the main system pump is automatically apportioned between the various cylinders 32 and 38 to supply the same constant pressure against the pistons of these motors. Insofar as cylinders 32 are concerned, the pressure applied to pistons of cylinders 32 acts directly upon the lift platform to move the platform vertically at a rate which bears a constant relationship to the rate at which fluid under pressure flows into the cylinders 32. Because of the geometry of the crank and link arrangement which couples the piston rods of cylinders 38 to the platform, the rate at which the platform is driven upwardly by cylinders 38 does not have a constant relationship to the rate at which fluid under pressure is supplied to the cylinders 38. Because the pistons of both cylinders 32 and cylinders 38 are mechanically coupled to the rigid lift platform, if the crank linkage coupling the pistons of cylinders 38 to the platform attempts to move the platform more rapidly than the rate at which the pistons of cylinders 32 would normally move the platform, to equalize the pressure applied in all cylinders, the hydraulic circuit automatically diverts more of the output of the pump to cylinders 32. Thus, in the system of FIGS. 3 and 4 during the initial portion of the upward stroke, when the mechanical advantage of the crank-linkage system coupled to the pistons of cylinders 38 is at a minimum, the major portion of the lifting force applied to the platform is supplied by the pistons of the cylinders 32, and as the mechanical advantage of the crank-linkage arrangement operated by cylinders 38 increases the portion of the fluid output of pump 10 supplied to cylinders 38 increases.

Figure 5:
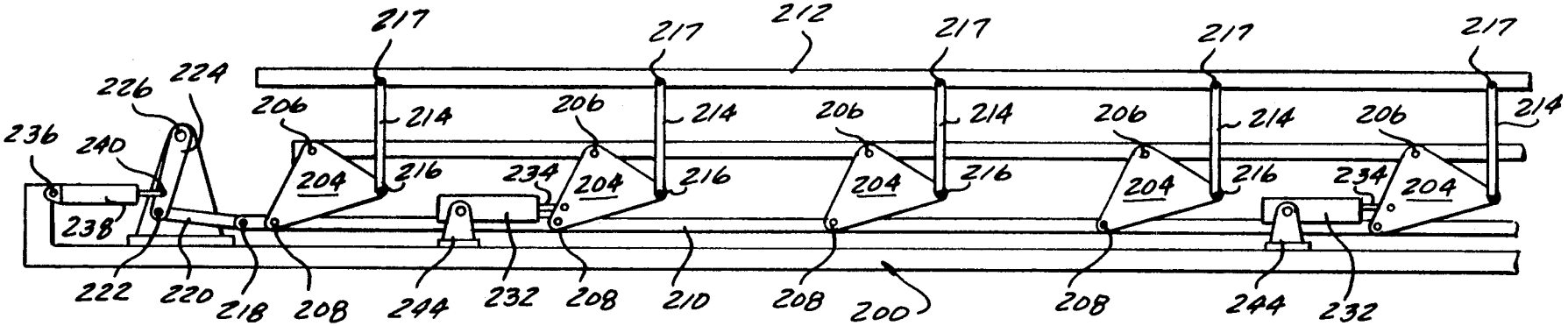
FIG. 5 is a side elevational view of a portion of an elongate lift table employing an alternative form of lift mechanism.

A second system adapted for use in applications where a relatively long lift platform, such as might be employed in a lift and transfer system, for example, as shown in FIG. 5.

The system shown in FIG. 5 includes an elongate main fixed frame designated generally 200 which includes a fixedly mounted generally horizontally extending fixed frame member 202. A plurality of rigid triangular shaped bell cranks 204 are pivotally mounted upon the frame member 202 at uniformly spaced intervals along frame member 202 as by pivots pins 206. Each of bell cranks 204 is connected by a pivot pin 208 to an elongate drag link 210, the pivot pins 208 being uniformly spaced along drag link 210 at the same spacing established between the fixedly located pivots 206. Thus, all of bell cranks 204 are coupled to each other by drag link 210 and are constrained by drag link 210 to move in unison about their respective pivots 206. An elongate lift table 212 is cooperatively supported upon the bell cranks 204 by links 214 pivotally mounted at their lower ends upon the bell cranks by pivots 216 and at their upper ends by pivots 217.

One end of drag link 210 is pivotally coupled at one end by a pivot 218 to one end of a link 220 whose opposite end is connected by pivot 222 to the distal end of a crank 224. Crank 224 is mounted for movement upon a fixed pivot 226 located on a mounting bracket 228 fixedly mounted on frame 200. The piston rod 240 of a cylinder 238 is pivotally coupled as at 230 to an intermediate location on crank 224. Cylinder 238 being pivotally mounted upon frame 200 as by a pivot 236. Cylinder 238 may be a double rodded cylinder like cylinder 38 of FIG. 2A or may be a three chamber cylinder of the same construction as the cylinder 32 of FIG. 2, with port 72 of the cylinder vented.

A second series of cylinders 232 have their piston rods 234 pivotally connected to certain ones of the bell cranks 204 as by pivot pins 242. Cylinders 232 are three chamber cylinders of the construction of cylinder 32 of FIG. 2 and their ports 72 (FIG. 2) are connected in the circuit of FIG. 1 to counterbalance circuit 84 to counterbalance the weight of platform 212. Cylinders 232 are pivotally mounted upon frame 200 as by mounting brackets 244.

Cylinders 232 are spaced along the length of frame 200 to uniformly distribute the force applied by the cylinders during operation to the pivotal connections of the linkage system. In the particular arrangement shown in the drawings, a cylinder 232 is coupled to every fourth bell crank 204. For purposes of distributing the applied force, in this arrangement effectively each cylinder 232 is considered to apply driving force to the bell crank 204 to which its rod is directly connected and to the bell cranks 204 immediately upstream and downstream.

In FIG. 5, the lift platform 212 is shown in its lowermost position and the piston rods of the respective cylinders 232 and 238 are in their fully retracted position. It is believed apparent from FIG. 5 that pivotal movement of the bell cranks 204 in a counterclockwise direction about their respective pivots 206 will elevate the lift platform from the fully lowered position shown.

Figure 6:
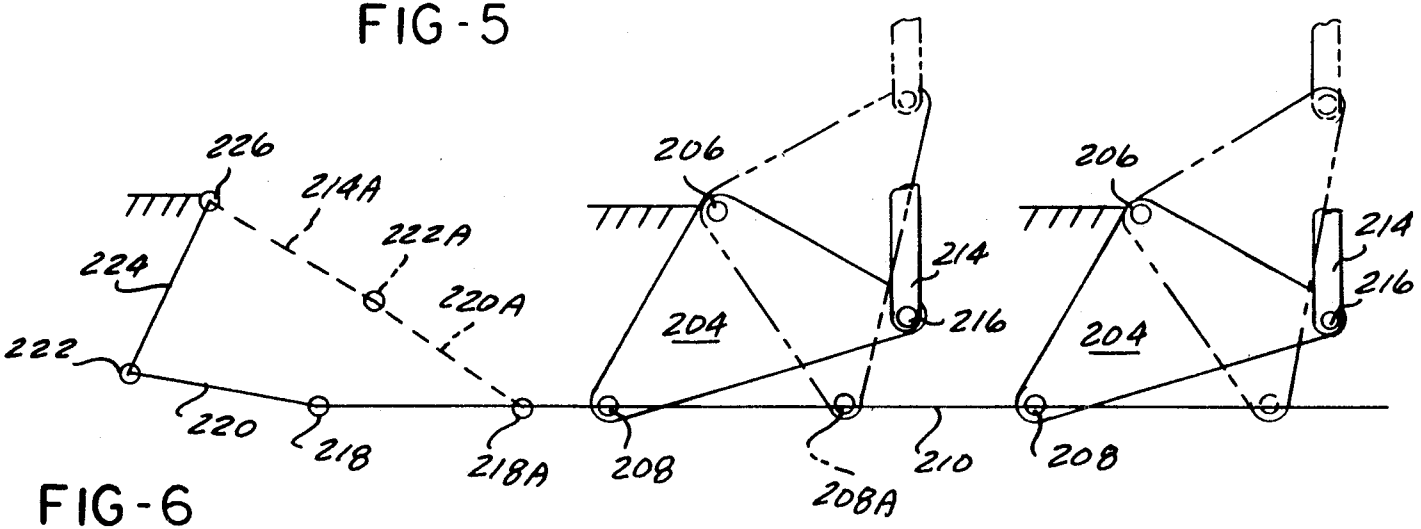
FIG. 6 is a schematic diagram of the linkage of the system of FIG. 5.

Lifting action imparted by cylinders 238 to the bell cranks via drag link 210 is best illustrated in the schematic diagram of FIG. 6. With the lift platform in its fully lowered position, drag link 210 is horizontal (and remains so throughout its full range of movement), while link 220 coupling drag link 210 to crank 224 is inclined slightly upwardly from the horizontal so that pivot 222 is slightly above pivot 218. To drive the bell cranks 204 in lifting movement, cylinder 238 is actuated to extend its piston rod 240 to drive crank 224 in counterclockwise movement about pivot 226 to swing pivot 222 along the arc A of FIG. 6. The full stroke of rod 240 of cylinder 238 shifts the pivot 222 from the full line position shown in FIG. 6 to the position indicated at 222A in broken line in FIG. 6. This movement is transmitted by link 220 to shift drag link 210 to the right, swinging the bell cranks 204 from their full line positions shown in FIG. 6 to the broken line positions shown in FIG. 6. When pivot 222 is in the positions indicated at 222A in FIG. 6, the pivot is slightly over center that is above—a straight line connecting crank axis 226 to pivot 218 when pivot 218 is at the position indicated at 218A in FIG. 6.

The lifting action applied by cylinders 232 to lift table 212 via bell cranks 204 is substantially a direct action. The geometry of linkage is such that a full stroke of the piston rod 234 of each cylinder 232 drives the pivot 242 connecting it to its bell crank along an arc centered at the associated pivot 206 which is bisected by a vertical line through pivot 206, this arc closely approximating a horizontal path. The motion of pivot 216 on the bell crank in an elevating stroke finds the pivot 216 directly vertically above its original position at the end of the stroke.

The motion imparted to lift platform 212 by cylinders 232 is essentially constant throughout the stroke in that although the pivots 242 and 216 move along arcuate paths, the curvature of these paths is relatively large and the divergence of the paths from straight line motion is therefore small.

The motion imparted to platform 212 via crank 224, link 220 and drag link 210 is, however, variable throughout the stroke. Initially, upon movement away from the fully lowered position shown in FIG. 5, pivot 222 moves essentially in a horizontal direction with only a minor component of vertical motion, hence drag link 210 will initially move relatively rapidly. As pivot 222 begins to swing upwardly, link 220 moves further out of direct alignment with drag link 220, and hence horizontal movement of drag link 210 will slow down and be reduced to zero at the point where link 220 and crank 224 are in straight line alignment with each other. This plus the deceleration of the hydrostatic drive enables the lift table 212 to decelerate smoothly to a stop at its fully elevated position.

While two embodiments of the invention has been described in detail, it will be apparent to those skilled in the art the disclosed embodiments may be modified. Therefore, the foregoing description is to be considered exemplary rather than limiting, and the true scope of the invention is that defined in the following claims.

I claim:

1. In a hydraulic fluid pressure operated system for raising and lowering a lift platform guided for vertical movement relative to a fixed frame, said system including a variable displacement main system pump, a plurality of hydraulic cylinders having reciprocable piston rods, directional control valve means hydraulically connecting said cylinders in parallel in a closed loop system to said main pump to selectively drive said piston rods in unison forward or return strokes between opposite end limits of movement, and mechanical coupling means coupling said piston rods to said platform at respective locations symmetrically disposed about said platform to raise or lower said platform between a raised and a lowered position in response to stroking movement of said piston rods between said end limits;

the improvement wherein said plurality of hydraulic cylinders comprises a first set of one or more cylinders and a second set of cylinders, said mechanical coupling means comprising first motion transmitting means for transmitting stroking movement of the rods of said first set of cylinders to said platform throughout the full range of movement of said platform between said raised and said lowered position, and second motion transmitting means for transmitting stroking movement of the rods of said second set of cylinders to said platform throughout the full range of movement of said platform between said raised and said lowered position, at a rate variable over the stroke of the last mentioned rods which differs from the rate at which motion of the rods of said first set of cylinders is transmitted to said platform.

2. The invention defined in claim 1 wherein said first motion transmitting means comprises a shaft mounted on said frame for rotation about a fixed horizontal axis, a first crank fixedly mounted on said shaft and pivotally coupled to the rods of said first set of cylinders for movement about said axis through an angle of substantially less than 180° in response to a full stroke of the rods coupled thereto, a second crank fixedly mounted on said shaft, and rigid link means interconnected between said second crank and said platform.

3. The invention defined in claim 2 wherein said first and second cranks are angularly displaced about said axis from each other, said first crank extending substantially vertically of said axis at the midpoint of the stroke of the rod coupled thereto and said second crank and said link extending substantially vertically of said axis when said platform is at its raised position.

4. The invention defined in claim 3 wherein said second motion transmitting means comprises coupling means directly coupling the rods of said second set of cylinders to said platform, said second set of cylinders having means therein defining three hydraulically isolated chambers exposed to three separate areas of the piston, two of said areas being equal and on opposite sides of the piston and exposed in two of said chambers which are connected to said directional control valve, and counterbalance pressure source means hydraulically connected to the third chamber to apply pressure to the third area of said piston substantially counterbalancing the weight of said platform.

5. The invention defined in claim 1 wherein said second coupling means comprises second members mounted on said frame for rotation about respective uniformly spaced parallel fixed horizontal second axes and pivotally coupled to said platform, a first member mounted on said frame for rotation about a first axis parallel to said second axes, a drag link pivotally connected to the respective second members at uniformly spaced locations along said drag link, a first link pivotally connected at opposite ends to said drag link and to said first member, and means coupling the rods of said second cylinders to certain of said second members.

6. The invention defined in claim 5 wherein said first motion transmitting means comprises means pivotally coupling the rods of said first set of cylinders directly to said first member.

7. The invention defined in claim 5 wherein said first member is a crank arm pivotally coupled at its distal end to said first link, said first link being located in substantial end to end alignment with said drag link when said platform is in its lowered position and being located in substantial end to end alignment with said crank arm when said platform is in its raised position.

8. The invention defined in claim 5 wherein said platform is of an elongate rectangular configuration and said second axes extend transversely of said platform at uniformly spaced locations along the length of said platform, said first member being mounted adjacent one end of said platform and said drag link extending horizontally parallel to the length of said platform.

9. The invention defined in claim 8 wherein the number of said second members is greater than the number of said second set of cylinders, the cylinders of said second set of cylinders being located on said frame at uniformly spaced intervals along the length of said platform.

10. The invention defined in claim 8 wherein said second motion transmitting means are coupled to every fourth second member.

* * * * *